US006142754A

United States Patent [19]

Hsiao et al.

[11] Patent Number: 6,142,754

[45] **Date of Patent: *Nov. 7, 2000**

[54] MOUNTING MECHANISM FOR A SCROLL MACHINE

[75] Inventors: Tse-Liang Hsiao; Yu-Choung Chang; Kun-I Liang; Chun-Chung Yang

[73] Assignee: Industrial Technology Research Institute, Hsinchu, Taiwan

[ * ] Notice: This patent is subject to a terminal disclaimer.

[21] Appl. No.: 09/107,360

[22] Filed: Jun. 29, 1998

[51] Int. Cl.[7] ..... F01C 1/02

[52] U.S. Cl. ..... 418/55.1; 418/55.3

[58] Field of Search ..... 418/55.1, 55.3

[56] References Cited

U.S. PATENT DOCUMENTS 4,575,318 3/1986 Blain ..... 418/55.1
5,178,526 1/1993 Galante et al. ..... 418/55.3
5,921,762 7/1999 Chang et al. ..... 418/55.3

*Primary Examiner*—Thomas Denion
*Assistant Examiner*—Thai-Ba Trieu
*Attorney, Agent, or Firm*—W. Wayne Liauh

[57] ABSTRACT

A mounting mechanism for a scroll machine comprises a non-orbiting scroll member which further includes a top seal plate, a non-orbiting scroll wrap extruding downward from bottom surface of the top seal plate, and a first locating element located at rim of the top seal plate; an orbiting scroll member which further includes a bottom seal plate and an orbiting scroll wrap extruding upward from top surface of the bottom seal plate; a frame for bearing the orbiting scroll member to operate along a circular orbit with respect to the non-orbiting scroll member which further includes a second locating element. The present invention is characterized in that, while the scroll machine in assembling, precise mounting of the non-orbital scroll member upon the orbiting scroll member can be easily secured by aligning and engaging the second locating element with the first locating element.

21 Claims, 6 Drawing Sheets

MOUNTING MECHANISM FOR A SCROLL MACHINE

BACKGROUND OF THE INVENTION (1) Field of the Invention

The invention relates to a mounting mechanism for a scroll machine, and more particularly to which utilizes a built-in mounting mechanism for lowering down assembly errors and reducing difficulty in assembling.

(2) Description of the Prior Art

A conventional scroll machine or a volute compressor in the art, structured as shown in FIG. 1, comprises mainly a shell 10, a non-orbiting scroll member 24 installed inside the shell 10, an orbiting scroll member 30, and other necessary components. While in meshing of the non-orbiting scroll member 24 and the orbiting scroll member 30, each having continuous individual involute blade, a plurality of closed compression chamber 34 are formed separately between contact lines of blades for accommodating working media (either gas or fluid). Those compression chambers 34 are moving with the contact lines of two blades in operation, and the occupied volume of a compression chamber 34 become less and less as it moves toward center of the scroll member 24 or 30 for obtaining a compressing effect upon the working media confined in the compression chamber 34. Inside the shell, space above the fixed volute is called a high pressure room 18. The inlet of the high pressure room 18 is formed as an axle hole 22 of the neck 26 located along the center of the non-orbiting scroll member 24. The eccentric motion of the orbiting scroll member 30 is driven by a motor 3 located beneath thereof.

Notwithstanding, if position or angular error occur while assembling scroll members 24 and 30 in a conventional scroll machine, it is quite possible that the separation of compression chamber 34 will lose and the working media inside a compression chamber 34 will leak through the slit existing at root or top of the adjacent contact line, and thus the compression capacity of the scroll machine will be greatly reduced. To avoid possible ill-closeness in forming the compression chambers 34, accuracy in producing the relative components and an improved mounting means for the scroll members are two major resorts.

As exemplified by the disclosures in the U.S. Pat. Nos. 4,767,293 and 4,877,382, the non-orbiting scroll member is provided in the back thereof with a biasing piece device which is fastened securely with a frame by means of bolts in conjunction with a locating piece. In the meantime, the biasing piece device is locked with the non-orbiting scroll member by another set of bolts. The non-orbiting scroll member is capable of moving axially. The moving distance of the non-orbiting scroll member is regulated by the interval between the planar surface of the frame holding the non-orbiting scroll member and the planar surface of the frame locking the biasing piece device, as well as the rim thickness of the non-orbiting scroll member. When the working media in the compression chamber has an abnormal pressure, the axial separation force of the compression chamber is greater than the axial sealing force exerting on the back of the non-orbiting scroll member. As a result, a gap is formed between the orbiting scroll member and the non-orbiting scroll member which must overcome the elastic force of the biasing piece by retreating to the planar surface of the biasing piece, which is pressed by the locating piece and is locked with the frame. The prior art improvements described above arc defective in design in that the improvements are attained by means of a number of elements at the expense of manufacturing efficiency and assembly precision.

Another prior art improvement is disclosed in the U.S. Pat. No. 5,102,316, this disclosure deals with the non-orbiting scroll member which is provided in the back thereof with a bushing device which is secured to a frame by means of bolts. The non-orbiting scroll member is capable of moving axially in conjunction with the bushing device. The axial displacement amount of the non-orbiting scroll member is determined by the difference the rim thickness of the non-orbiting scroll member and the height of the bushing device. In the meantime, the bottom of the nut serves as a locating surface. When the working media in the compression chamber has an abnormal pressure, the non-orbiting scroll member retreats to the locating surface so as to cause the formation of a gap between the orbiting and the non-orbiting scroll members for discharging the working media. The prior improvement is involved with fewer working elements. However, the non-orbiting scroll member is susceptible to being poorly located or being loosened unless the bushing device, the non-orbiting scroll member, and the frame are fastened together with precision. Moreover, an additional work must be done with the bottom of the nut, which serves as the locating surface. As a result, this prior art improvement is relative expensive.

Therefore, an invention devoting to resolving aforesaid disadvantages of conventional scroll machine in locating the scroll members is necessary, definitely.

SUMMARY OF THE INVENTION

Accordingly, it is a primary object of the present invention to provide a mounting mechanism for a scroll machine, which will facilitate the mounting and locating of scroll members with ease and precision.

A mounting mechanism for a scroll machine in accordance with the present invention comprises a non-orbiting scroll member having a first locating element, an orbiting scroll member for meshing with the non-orbiting member, and a frame for bearing the orbiting scroll member and for providing a second locating element.

Said non-orbiting scroll member further comprises a top seal plate, a non-orbiting scroll wrap extruding thereof downward from bottom surface of the top seal plate, and the first locating element located at rim of the top seal plate.

Said orbiting scroll member further comprises a bottom seal plate and an orbiting scroll wrap extruding thereof upward from top surface of the bottom seal plate. While the orbiting scroll member in assembling with the non-orbiting scroll member, top surface of the orbiting scroll wrap is substantially co-planar with bottom surface of the top seal plate of the non-orbiting scroll member, lower surface of the non-orbiting scroll wrap is substantially co-planar with top surface of the bottom seal plate of the orbiting scroll member, and thus a plurality of compression chambers are formed between the orbiting scroll member and the non-orbiting scroll member.

Said frame, for bearing the orbiting scroll member to operate along a circular orbit with respect to the non-orbiting scroll member, further comprises the second locating element. While in assembling, precise mounting of the non-orbital scroll member upon the orbiting scroll member can be secured by aligning and engaging the second locating element with the first locating element.

It is another object of the present invention to provide a mounting mechanism for a scroll machine, which, by providing the first locating element and the corresponding second locating element, saves labors in reducing the assembly error while mounting the orbiting and the non-orbiting scroll members.

It is a further object of the present invention to provide a mounting mechanism for a scroll machine, which reduces the cost on manufacturing a scroll machine by providing the first and the matching second locating elements and by saving the calibration process in adjusting the engagement of the orbiting and the non-orbiting scroll members.

All these objects are achieved by the mounting mechanism for a scroll machine described below.

BRIEF DESCRIPTION OF THE DRAWINGS

The present invention will now be specified with reference to its preferred embodiments illustrated in the drawings, in which.

DESCRIPTION OF THE PREFERRED EMBODIMENT

The invention disclosed herein is directed to a mounting mechanism for a scroll machine. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
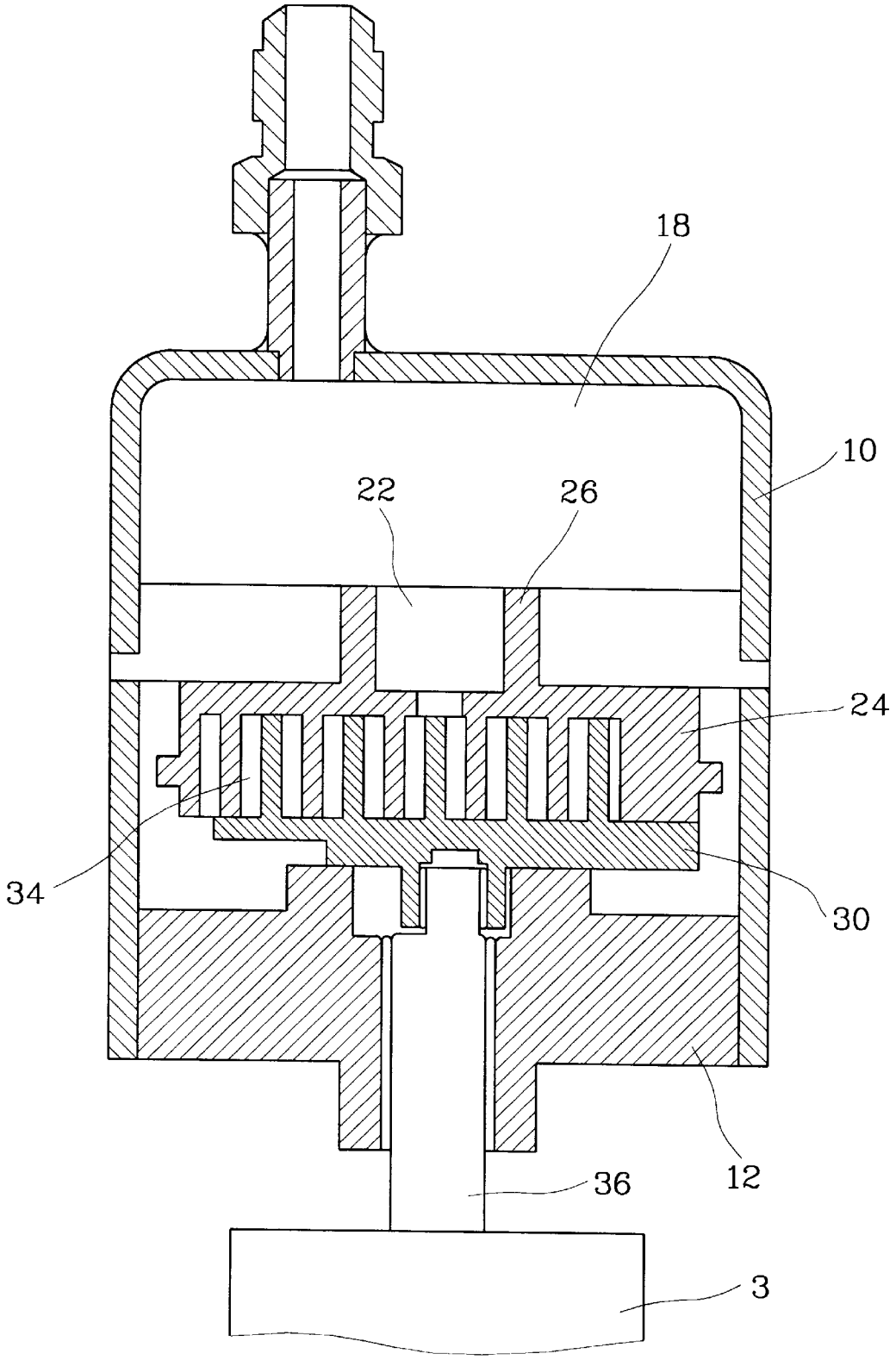
FIG.1 (PRIOR ART)
FIG. 1 is a schematic sectional view of a scroll machine in the art.
Figure 2:
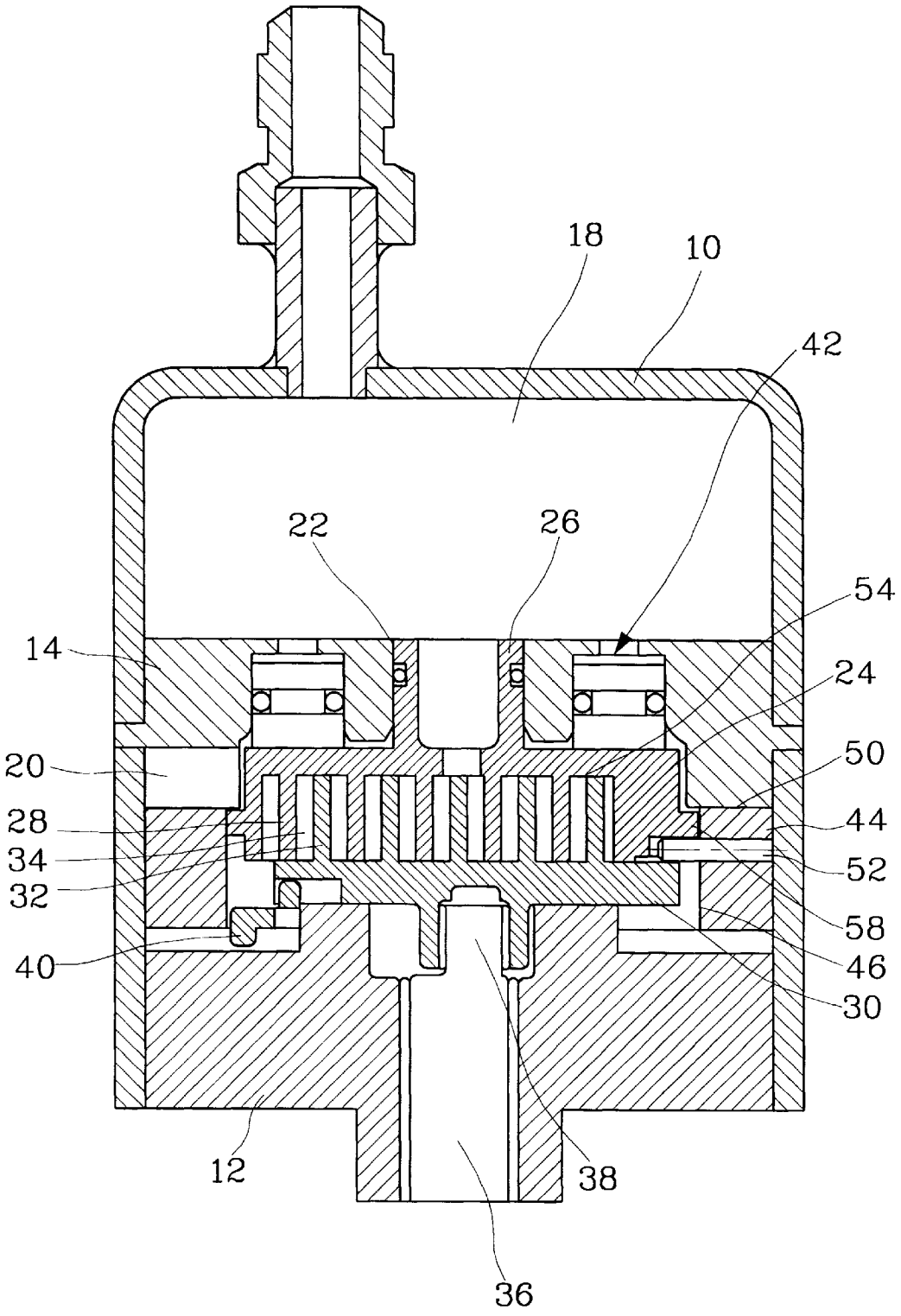
FIG. 2 is a schematic sectional view of a scroll machine applying the preferred mounting mechanism in accordance with the present invention.

Referring now to FIG. 2, the mounting mechanism for a scroll machine in accordance with the present invention comprises a shell 10, a frame 12, a separating member 14, a non-orbiting scroll member 24, an orbiting scroll member 30, a rotary shaft 36, an eccentric pin 38, an Oldham ring 40, and a back pressure mechanism 42.

The shell 10 in accordance with the present invention can be formed as a cylindrical container with a lower open end (showing only the upper half of the shell 10 in FIG. 2) for accommodating parts of the scroll machine.

The frame 12 according to the present invention, locating inside the shell 10, is used for bearing the orbiting scroll member 30 to operate along a circular orbit with respect to the non-orbiting scroll member 24. As shown in FIG. 2, the frame 12 can be installed close to the lower open end of the shell 10, in order to form a substantial room inside the upper half of the shell 10 for accommodating parts of the scroll machine.

The separating member 14, located inside the shell 10 and above the frame 12, is used and mounted to divide aforesaid room into two chambers; a high-pressure chamber 18 located at the upper half of the room, and a lower-pressure chamber 20 located between the separating member 14 and the frame 12. According to the present invention, the separating member 14 further includes an axle hole 22 at the center of the separating member 14, for providing a through passage between the high-pressure chamber 18 and the lower-pressure chamber 20, in which the orbiting scroll member 30 and the engaging non-orbiting scroll member 24 locates.

According to the present invention, the non-orbiting scroll member 24 comprises a top seal plate 54, a non-orbiting scroll wrap 28 extruding downward from bottom surface of the top seal plate, and a neck 26 extruding upward from central top surface of the top seal plate for providing a pivot shaft to the axle hole 22 of the separating member 14. The non-orbiting scroll wrap 28, which is a continuous volute over the bottom surface of the top seal plate of the non-orbiting scroll member 24 and with a substantial thickness and height, can be an involute scroll wrap or any the like orthogonal-type scroll wrap.

The orbiting scroll member 30, located between the non-orbiting scroll member 24 and the frame 12, comprises a bottom seal plate 56 and an orbiting scroll wrap 32 extruding upward from top surface of the bottom seal plate. The orbiting scroll wrap 32, which is a continuous volute over the top surface of the bottom seal plate of the orbiting scroll member 30 for meshing with the non-orbiting scroll wrap 28 to form a plurality of compression chambers 34 and with a corresponding thickness and height, can be an involute scroll wrap or any the like orthogonal-type scroll wrap capable of meshing with the non-orbiting scroll wrap 28.

The rotary shaft 36 penetrating the frame at the center thereof has its upper end anchoring to the bottom of the orbiting scroll member 30 through the eccentric pin 38, and has another end connected with and driven by a motor locating under the frame 12 (not shown in figures).

According to the present invention, the Oldham ring 40 is located between the frame 12 and the orbiting scroll member 30 for preventing the orbiting scroll member 30 from arbitrary rotating.

The back pressure mechanism 42 is mounted inside the separating member 14 and on top of the non-orbiting scroll member 24 for providing a preset pressure to assure the tight contact between the non-orbiting scroll member 24 and the orbiting scroll member 30. The technique regarding the back pressure mechanism has been disclosed in R.O.C (Taiwan) Pat. Ser. No. 83206713.

As mentioned in the section of background of the invention, a scroll machine in the art used to have disadvantages in locating and calibrating after assembly. The mounting mechanism for a scroll machine in accordance with the present invention is characterized in that the positioning among the frame 12, the orbiting scroll member 30, and the non-orbiting scroll member 24 can be assured during the assembly by applying a first locating element on the non-orbiting scroll member 24 and a corresponding second locating element on the frame 12. By providing the first and the second locating elements, precise positioning of the frame 12, the orbiting scroll member 30, and the non-orbiting scroll member 24 can be guaranteed without labor-consuming calibration process after assembly.

Figure 3A:
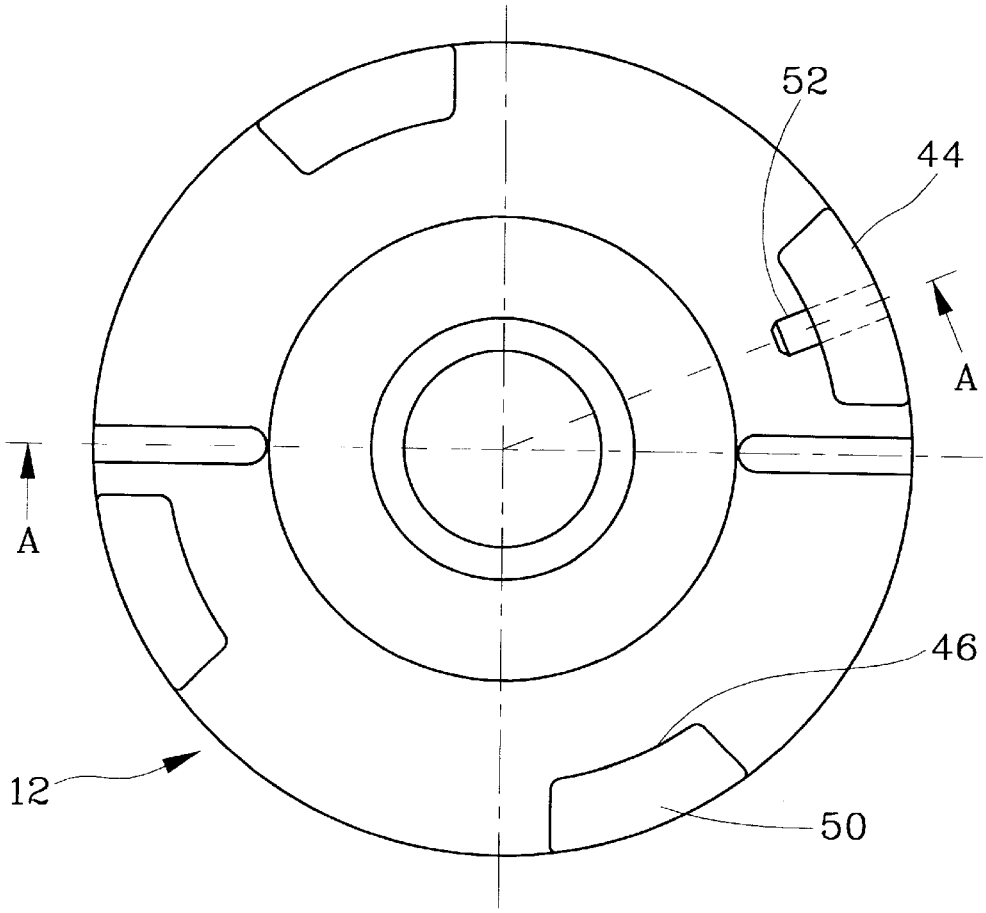
FIG. 3A is a top view of the preferred frame of the mounting mechanism for a scroll machine in accordance with the present invention.
Figure 3B:
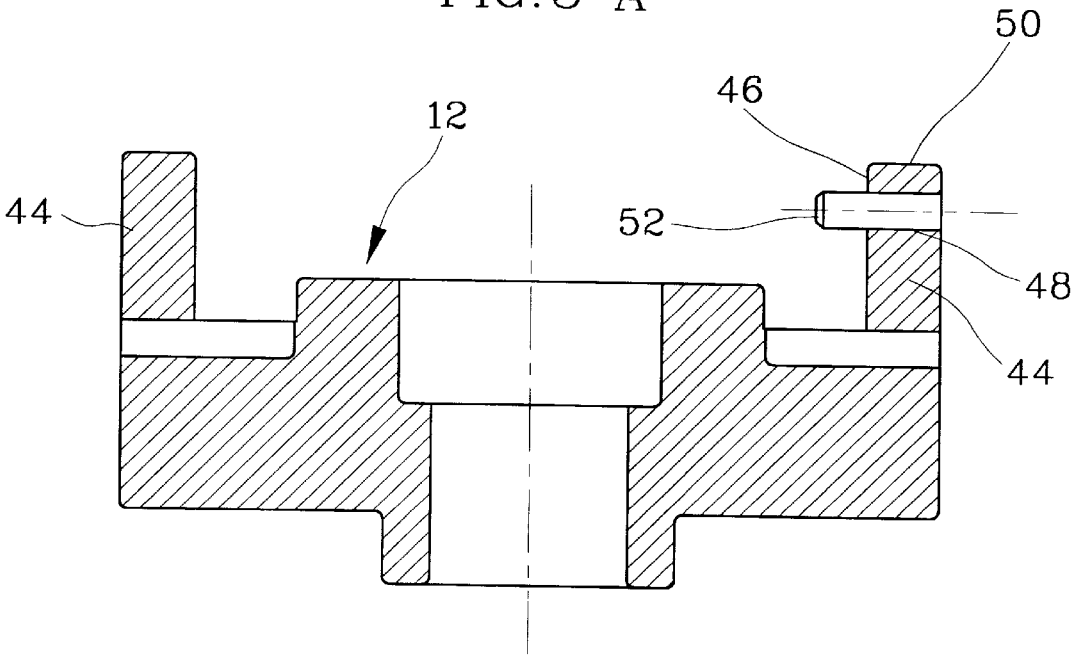
FIG. 3B is a sectional view along line A—A in FIG. 3A.

Referring now to FIG. 3A and FIG. 3B, the preferred embodiment of the frame 12 in accordance with the present invention is shown. The preferred frame 12 further comprises a plurality of upright pillars 44 with arc inner face 46 circulated around the rim of the frame 12. These pillars 44 can be arranged at equal-spacing and can come from portion of a same cylindrical shell co-centering with the frame 12. Moreover, top surfaces 50 of these pillars 44 can be arranged at the same level for providing a flat locating surface. Aforesaid second locating element can be individually formed by a drill hole 48 on one pillar 44 and a radial anchoring pin 52 directed inward and tightly held by the drill hole 48. According to the present invention, the cross section of the drill hole 48 and the anchoring pin 52 can be round, square, or any other geometrical profile.

While in assembling (see FIG. 2), the Oldham ring 40 is located on top of the frame 12 and in mid of the pillars 44. The orbiting scroll member 30 is then mounted on top of the Oldham ring 40, with the orbiting scroll wrap 32 directing upward. The non-orbiting scroll member 24 is then located on top of the orbiting scroll member 30 with the non-orbiting scroll wrap 28 directing downward and firmly engaging with the orbiting scroll wrap 32 for forming a plurality of the compression chamber 34 in between. On top of the non-orbiting scroll member 24, the separating member 14 is mounted. The bottom surface of the separating member 14 is also a good flat surface for positioning, and is used to contact the top surface 50 of the pillars 44 of the frame 12. The back pressure mechanism 42 is mounted between the separating member 14 and the non-orbiting scroll member 24.

As well-known in the art of the scroll machine, sliding pairs are utilized between the Oldham ring 40 and the frame 12, and between the Oldham ring 40 and the orbiting scroll member 30. Those sliding pairs can be variously formed, but precisely manufactured without any assembly problem. However, in the art, the non-orbiting scroll member 24 and the orbiting scroll member 30 is placed together without any pin-locating device as disclosed in the present invention. The calibration between both scroll wraps 28 and 32 are carried out with a third device, by technique as disclosed in those work described in the background section, after the orbiting and the non-orbiting scroll members 30 and 24 have been assembled.

According to the present invention, after assembly, the lower rim of the anchoring pin 52 can right contact with top surface of the bottom seal plate of the orbiting scroll member 30, in which the top surface of the bottom seal plate of the orbiting scroll member 30 is substantially co-planar with the lower end of the non-orbiting scroll wrap 28.

Figure 4A:
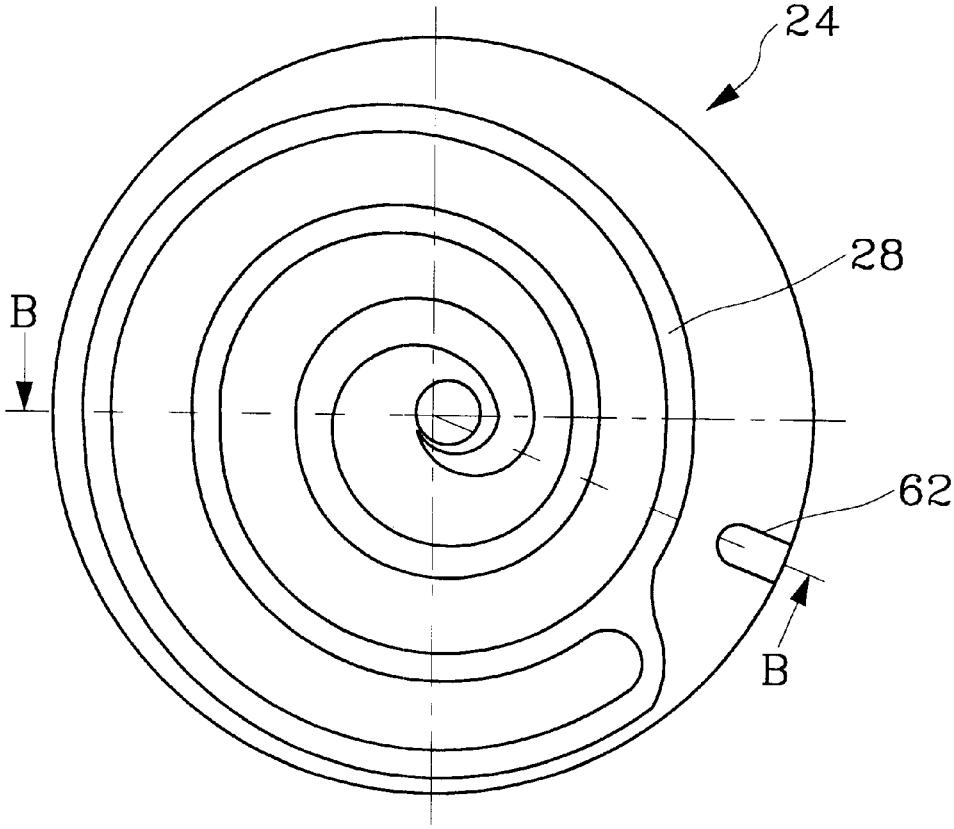
FIG. 4A is a bottom view of the preferred non-orbiting scroll member of the mounting mechanism for a scroll machine in accordance with the present invention.
Figure 4B:
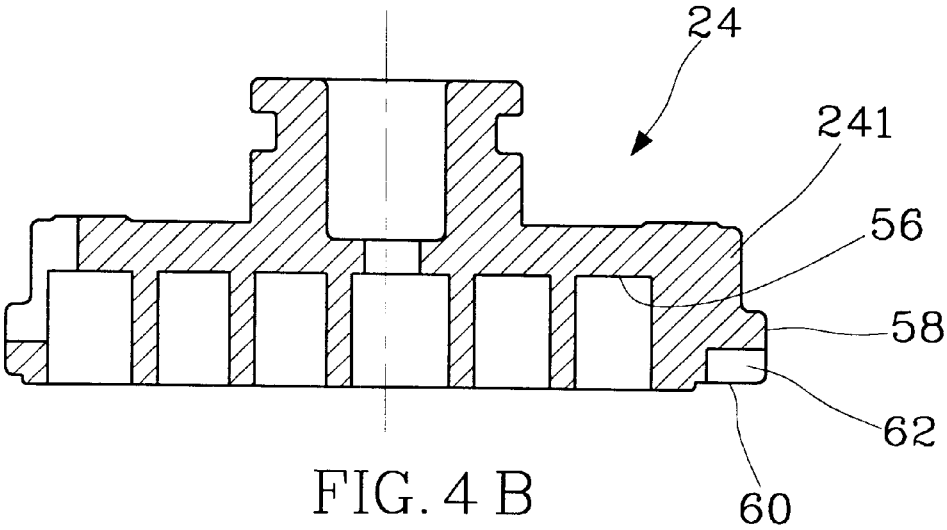
FIG. 4B is a sectional view along line B—B in FIG. 4A.

Referring now to FIG. 4A and FIG. 4B, the preferred non-orbiting scroll member 24 is shown. In the preferred embodiment, the non-orbiting scroll member 24 has a shoulder 241 located at the corresponding position with the anchoring pin 52 of the frame 12. The shoulder 241 includes a key way 62 at the bottom edge thereof, as the first locating element with respect to the second first locating element (i.e. the anchoring pin in FIGS. 3A and 3B). The key way 62 includes a portion below the flange 58. The key way 62 is designed and manufactured for receiving the anchoring pin 52. By providing the key way 62 and the engaging anchoring pin 52 with appropriate arranged, the lower end of the non-orbiting scroll wrap 28 can be substantially co-planar with the top surface of the bottom seal plate of the orbiting scroll member 30, the upper end of the orbiting scroll wrap 32 can be substantially co-planar with the bottom surface of the top seal plate of the non-orbiting scroll member 24, and the non-orbiting scroll wrap 28 is in mesh with the orbiting scroll wrap 32.

Basically, the purpose of the anchoring pin 52 (i.e. the second locating element) is on providing correct operational meshing between he non-orbiting scroll wrap 28 is in mesh with the orbiting scroll wrap 32 for rendering a plurality of close compression chambers 34. As the preferred embodiment shown in FIG. 2 to FIG. 4, the engagement among the orbiting scroll member 30, the Oldham ring 40, and the frame 12 is the sliding pair in the art and has no assembly problem. On the other hand, the engagement between the non-orbiting scroll member 24 and the orbiting scroll member 30 is less controllable in the art. Any deviation in assembly, either angular or linear, will cause poor meshing between the scroll wraps 28 and 32, and as a consequence the closeness of the compression chamber 34 will lose definitely. Notwithstanding, according to the present invention, optimal meshing between the scroll wraps 28 and 32 can be achieved merely by the engagement of the first locating element (for example, aforesaid key way 62) and the second locating element (for example, aforesaid locating pin 52), and the engagement accuracy can be embedded on and guaranteed in manufacturing the frame 12, the orbiting scroll member 30, and the non-orbiting scroll member 24, which is known as much controllable. In accordance with the present invention, as long as those parts are precisely manufactured, the perfect meshing between the scroll wraps 28 and 32 can be easily achieved by the engagement of the first and the second locating elements, and thus the assembly and calibration time for a correct meshing can be greatly reduced. Also, obviously, the meshing of wraps 28 and 32 in the present invention won't be affected by all other parts of the scroll machine.

Figure 5:
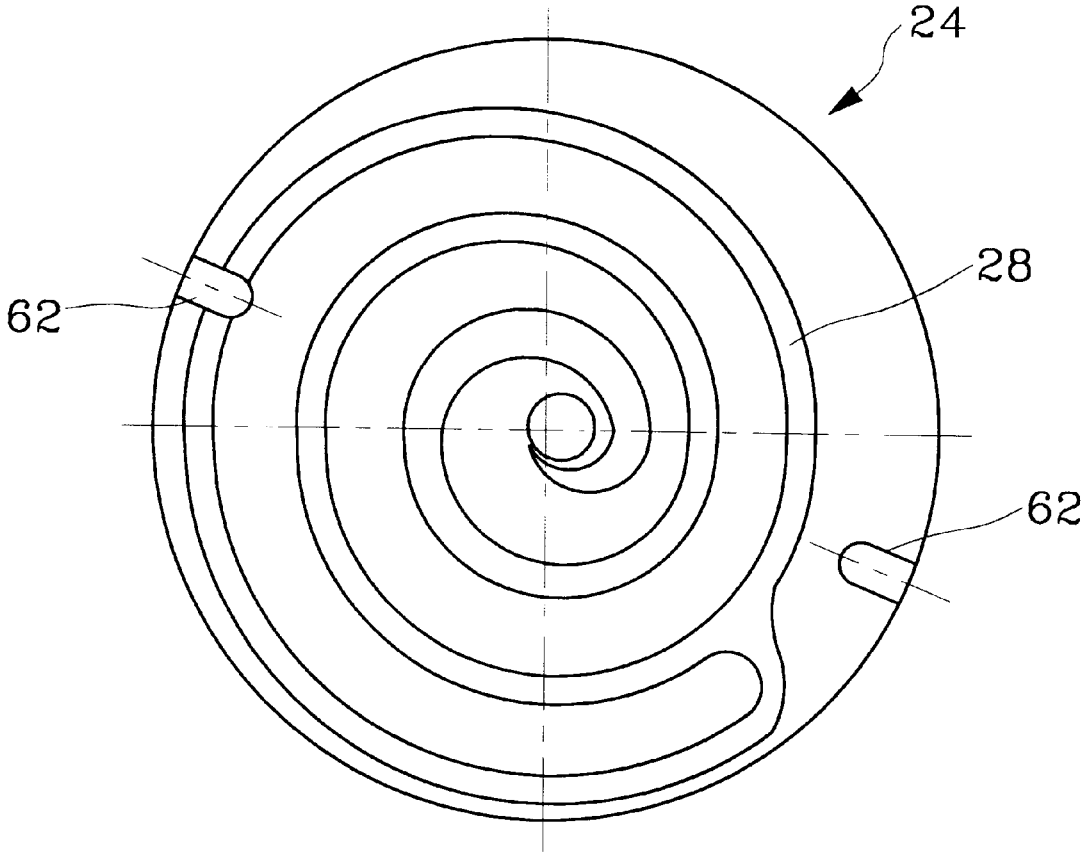
FIG. 5 is a bottom view of another embodiment of the non-orbiting scroll member of the mounting mechanism for a scroll machine in accordance with the present invention.
Figure 6:
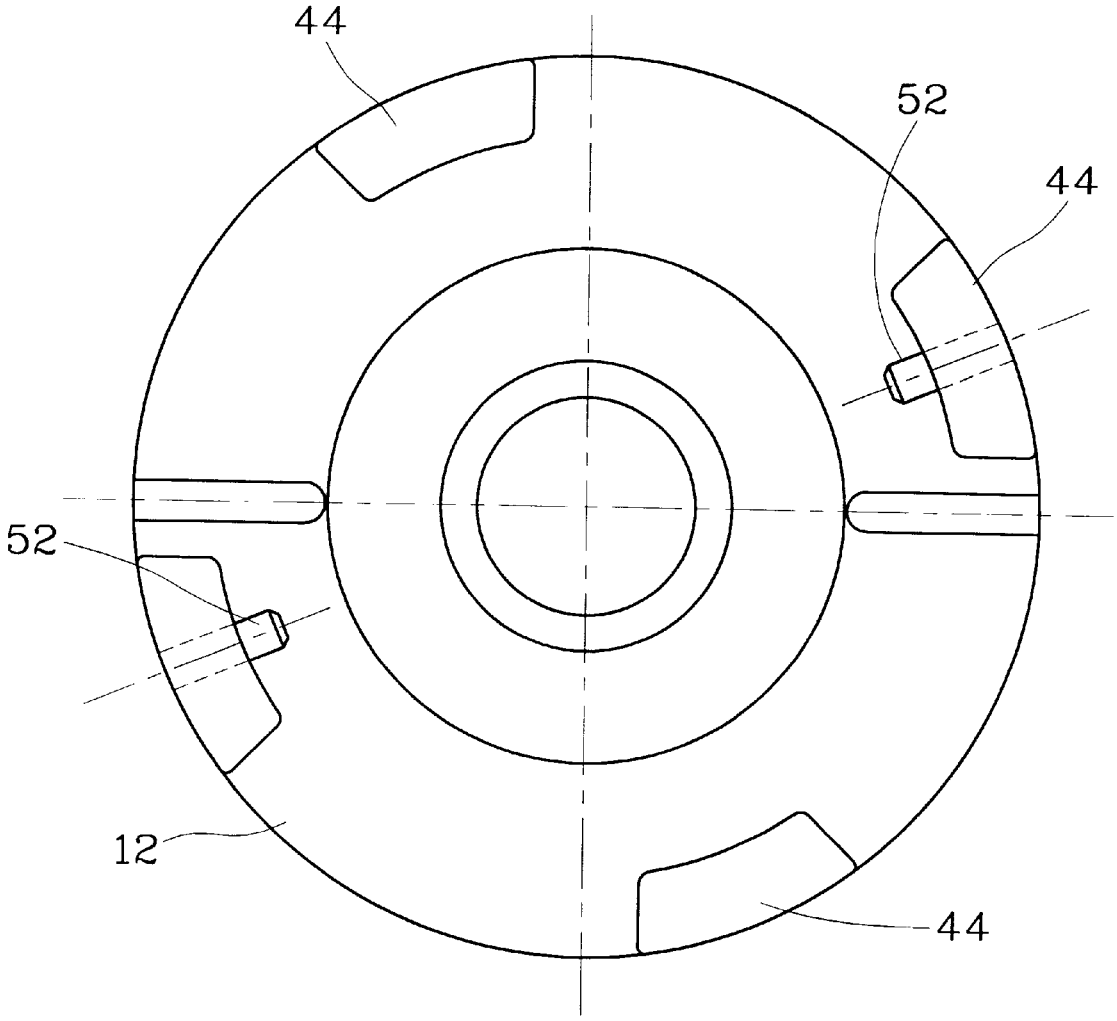
FIG. 6 is a top view of an embodiment of the frame which matches with the non-orbiting scroll member shown in FIG. 5.

Referring now to FIG. 5 and FIG. 6, another embodiments of the non-orbiting scroll member 24 and the frame 12 are shown, respectively. as shown in this embodiment, the second locating element of the non-orbiting scroll member 24 can be formed as a pair of key ways 62 located oppositely at the rim of the top seal plate thereof. Respectively, the first locating element on the frame 12, especially on the pillars 44, can be formed as a pair of corresponding anchoring pins 52.

It is apparent that, in practice, the first and the second locating elements can be variously formed, not merely confined to the aforesaid assembly of key ways, pins, and drill holes. The number and the spacing of the first and the second locating elements are also not restricted. In addition, the orientation arrangement of the first and the second locating elements can be arranged radial, oblique, or at any proper angle.

Moreover, in one more embodiment of the present invention, aforesaid anchoring pin 52 can be separately produced. While in assembling, the pin can be used as an element to align the drill hole on the frame 12 and the key way 62 on the non-orbiting scroll member 24.

According to the present invention, the practice of the first and the second locating elements can be various. Following is a list of some embodiments for the first locating element and the corresponding second locating element.

| First Locating Element (on the non-orbiting scroll member) | Second Locating Element (on the frame) |
|---|---|
| keyway | extruding anchoring pin |
| extruding anchoring pin | key way |
| key way | extruding anchoring pin on the pillar |
| extruding anchoring pin | key way on the pillar |
| key way | drill hole + anchoring pin |

-continued

| First Locating Element (on the non-orbiting scroll member) | Second Locating Element (on the frame) |
|---|---|
| key way | drill hole on the pillar + anchoring pin |

While the present invention has been particularly shown and described with reference to preferred embodiments, it will be understood by those skilled in the art that various changes in form and detail may be without departing from the spirit and scope of the present invention.

What is claimed is:

1. A mounting mechanism for a scroll machine, comprising:

a non-orbiting scroll member, further comprising a top seal plate, a non-orbiting scroll wrap extruding thereof downward from bottom surface of said top seal plate, and a first locating element located at rim of said top seal plate;

an orbiting scroll member, further comprising a bottom seal plate and an orbiting scroll wrap extruding thereof upward from top surface of said bottom seal plate; while in assembling with said non-orbiting scroll member, top surface of said orbiting scroll wrap substantially co-planar with bottom surface of said top seal plate of said non-orbiting scroll member, lower surface of said non-orbiting scroll wrap substantially co-planar with top surface of said bottom seal plate of said orbiting scroll member, and thus forming a plurality of compression chambers between said orbiting scroll member and said non-orbiting scroll member; and a frame for bearing said orbiting scroll member to operate along a circular orbit with respect to said non-orbiting scroll member, further having a second locating element; while in assembling, precise mounting of said non-orbital scroll member upon said orbiting scroll member being secured by aligning and engaging said second locating element with said first locating element.

2. The mounting mechanism for a scroll machine according to claim 1, wherein said first locating element is a key way, and said second locating element is an extruding anchoring pin.

3. The mounting mechanism for a scroll machine according to claim 2, wherein said extruding anchoring pin is radial arranged.

4. The mounting mechanism for a scroll machine according to claim 1, wherein said first locating element is an extruding anchoring pin, and said second locating element is a key way.

5. The mounting mechanism for a scroll machine according to claim 4, wherein said extruding anchoring pin is radial arranged.

6. The mounting mechanism for a scroll machine according to claim 1, wherein said frame further comprises a plurality of upright pillars circulated located around rim of said frame; wherein said first locating element locates on said non-orbiting scroll member and said second locating element locates on one of said pillars.

7. The mounting mechanism for a scroll machine according to claim 6, wherein said pillars are arranged at equal-spacing.

8. The mounting mechanism for a scroll machine according to claim 6, wherein said pillars come from portion of a same cylindrical shell co-centering with said frame.

9. The mounting mechanism for a scroll machine according to claim 6, wherein said first locating element is an extruding anchoring pin, and said second locating element is a key way.

10. The mounting mechanism for a scroll machine according to claim 9, wherein said extruding anchoring pin is radial arranged.

11. The mounting mechanism for a scroll machine according to claim 6, wherein said first locating element is a key way, and said second locating element is an extruding anchoring pin.

12. The mounting mechanism for a scroll machine according to claim 11, wherein said extruding anchoring pin is radial arranged.

13. The mounting mechanism for a scroll machine according to claim 6, wherein said first locating element is a key way, and said second locating element is combined by a drill hole located at said pillar and an anchoring pin for being plugged into said key way and said drill hole while in assembly.

14. The mounting mechanism for a scroll machine according to claim 1, wherein said first locating element is a key way, and said second locating element is combined by a drill hole located at said pillar and an anchoring pin for being plugged into said key way and said drill hole while in assembly.

15. The mounting mechanism for a scroll machine according to claim 14, wherein said key way and said drill hole are radial arranged.

16. A mounting mechanism for a scroll machine, comprising:

a frame, further having a plurality of upright pillars circulated located around rim of said frame and a number of anchoring pins extruding radial and inward and located on said pillars, each on one said pillar;

a non-orbiting scroll member, further comprising a top seal plate, a non-orbiting scroll wrap extruding thereof downward from bottom surface of said top seal plate, and a number of key ways located at rim of said top seal plate to account for said anchoring pins;

an orbiting scroll member, further comprising a bottom seal plate and an orbiting scroll wrap extruding thereof upward from top surface of said bottom seal plate; and an Oldham ring, located between said frame and said orbiting scroll member for preventing said orbiting scroll member from arbitrary rotating;

characterized in that, while in assembling said orbiting scroll member with said non-orbiting scroll member by engaging said key ways and said anchoring pins, top surface of said orbiting scroll wrap substantially is co-planar with bottom surface of said top seal plate of said non-orbiting scroll member, lower surface of said non-orbiting scroll wrap substantially is co-planar with top surface of said bottom seal plate of said orbiting scroll member, and thus a plurality of compression chambers are formed between said orbiting scroll member and said non-orbiting scroll member.

17. The mounting mechanism for a scroll machine according to claim 16, wherein said pillars come from portion of a same cylindrical shell co-centering with said frame.

18. The mounting mechanism for a scroll machine according to claim 16, wherein said anchoring pins are radial arranged.

19. A mounting mechanism for a scroll machine, comprising:

a frame, further having a plurality of upright pillars circulated located around rim of said frame and a number of drill holes located on said pillars, each on one said pillar;

a non-orbiting scroll member, further comprising a top seal plate, a non-orbiting scroll wrap extruding thereof downward from bottom surface of said top seal plate, and a number of key ways located at rim of said top seal plate to account for said drill holes;

an orbiting scroll member, further comprising a bottom seal plate and an orbiting scroll wrap extruding thereof upward from top surface of said bottom seal plate; and an Oldham ring, located between said frame and said orbiting scroll member for preventing said orbiting scroll member from arbitrary rotating; characterized in that, while in assembling said orbiting scroll member with said non-orbiting scroll member by engaging said key ways, said drill holes, and a certain number of anchoring pins for plugged inside said drill holes and said key ways, each for one said drill hole and corresponding said key way, top surface of said orbiting scroll wrap substantially is co-planar with bottom surface of said top seal plate of said non-orbiting scroll member, lower surface of said non-orbiting scroll wrap substantially is co-planar with top surface of said bottom seal plate of said orbiting scroll member, and thus a plurality of compression chambers are formed between said orbiting scroll member and said non-orbiting scroll member.

20. The mounting mechanism for a scroll machine according to claim 19, wherein said pillars come from portion of a same cylindrical shell co-centering with said frame.

21. The mounting mechanism for a scroll machine according to claim 19, wherein said number of said anchoring pins is one.

* * * * *

UNITED STATES PATENT AND TRADEMARK OFFICE

CERTIFICATE OF CORRECTION

PATENT NO. : 6,142,754
DATED : November 7, 2000
INVENTOR(S) : Hsiao

It is certified that error appears in the above-identified patent and that said Letters Patent is hereby corrected as shown below:

Title page,
Item [75], Inventors, Please add the following names, Ann-Huang, Ching-Feng Lai; and Ching-Feng Tsai; all of Hsinchu, Taiwan Signed and Sealed this Ninth Day of October, 2001

*Attest:*

Nicholas P. Godici

*Attesting Officer*

NICHOLAS P. GODICI
*Acting Director of the United States Patent and Trademark Office*